United States Patent [19]

Schütz

[11] Patent Number: 4,643,323

[45] Date of Patent: Feb. 17, 1987

[54] DRUM OF THERMOPLASTIC SYNTHETIC RESIN

[76] Inventor: Udo Schütz, 4, Am Rückersteg, D-5418 Selters, Fed. Rep. of Germany

[21] Appl. No.: 778,072

[22] Filed: Sep. 20, 1985

[30] Foreign Application Priority Data

Nov. 6, 1984 [DE] Fed. Rep. of Germany ..... 3440434

[51] Int. Cl.[4] ..... B65D 7/42; B65D 7/02

[52] U.S. Cl. ..... 220/72; 220/74; 220/5 R

[58] Field of Search ..... 220/72, 74, 73, 5 R, 220/66, 288, DIG. 1

[56] References Cited

U.S. PATENT DOCUMENTS

| | | | |
|---|---|---|---|
| 4,228,122 | 10/1980 | Hammes | 264/89 |
| 4,257,527 | 3/1981 | Snyder et al. | 220/72 |
| 4,378,328 | 3/1983 | Przytulla et al. | 220/72 |

*Primary Examiner*—George T. Hall

*Attorney, Agent, or Firm*—Young & Thompson

[57] ABSTRACT

The bunghole-equipped barrel of a thermoplastic synthetic resin with rolled rings arranged in the zone of the upper head (2) and the lower head coaxially to the barrel sidewall (1) is characterized in that the upper rolled ring (7) is molded in a bead shape directly from the barrel sidewall (1) and the upper head (2), and the lower rolled ring is molded in a bead shape directly from the barrel sidewall and the lower head, with the formation of respectively one annular cavity (9); and that an open gap (14) is formed between the upper marginal zone (10) of the barrel sidewall (1) and the outer marginal zone (11) of the upper head (2), as well as between the lower marginal zone of the barrel sidewall and the outer marginal zone of the lower head. For the formation of predetermined breaking points in case of external and/or internal overstressing, the upper marginal zone (10) of the barrel sidewall (1) is welded together spotwise over the barrel circumference with the outer marginal zone (11) of the upper head (2). In the same way, predetermined breaking points are formed at the lower rolled ring.

5 Claims, 7 Drawing Figures

DRUM OF THERMOPLASTIC SYNTHETIC RESIN

Figure 1:
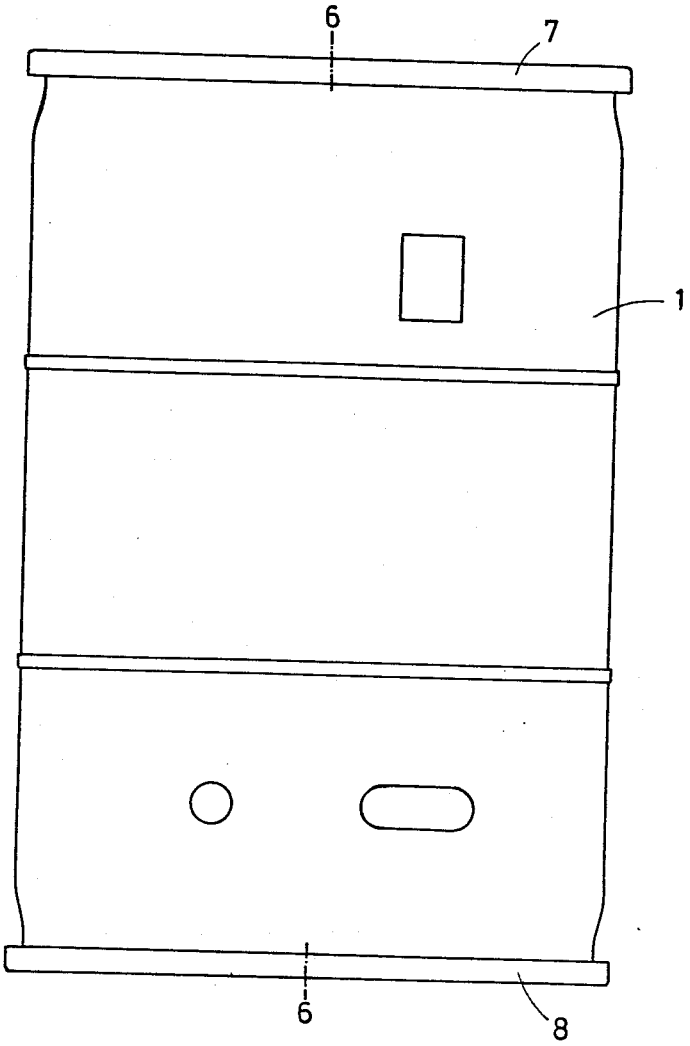

The invention relates to a barrel with bunghole, made of a thermoplastic synthetic resin.

Such barrels, known, for example, from U.S. Pat. No. 4,228,122, the rolled rings of which have an L-shaped profile, have the disadvantage that the barrel sidewall will rupture as a consequence of a relatively large external crushing force exerted on the top head and/or bottom head, for example in case of a drop from a moderate or large height. If the barrel hits the floor with the rolled hoops and/or rolled rings, there is the danger that the barrel sidewall bursts in the zone of the rolled rings due to the external bending and compressive forces acting thereon. There is furthermore the drawback that, after blow molding of the barrel, warp stresses or thermal stresses occur during cooling in the region of the rolled ring on account of the accumulation of material; these stresses can lead to stress cracks in the barrel sidewall when it is subjected to external forces. Finally, the forming of the rolled rings with the L-shaped cross-sectional profile by means of heading during the blow molding of the barrels is possible only with production of creases, likewise resulting in the danger of crack formation when external forces become effective.

The invention is based on the object of developing a bunghole-equipped barrel of a thermoplastic synthetic resin which is distinguished over conventional bunghole-equipped barrels by a substantially higher safety against accidents in case of the action of forces from the outside as well as inside that exceed the admissible extent.

Suitable embodiments of the invention are set forth in the dependent claims.

Besides the advantage derivable from the recitation of objects, the invention is distinguished by the additional advantages mentioned in the description of various embodiments set out below.

Figure 3:
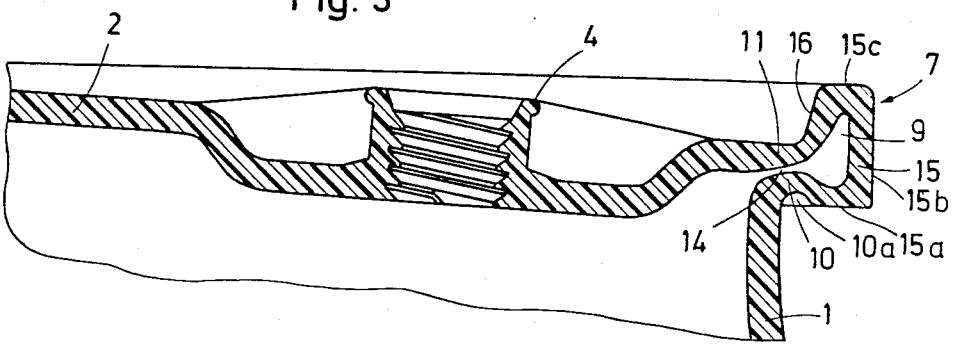
Figure 2:
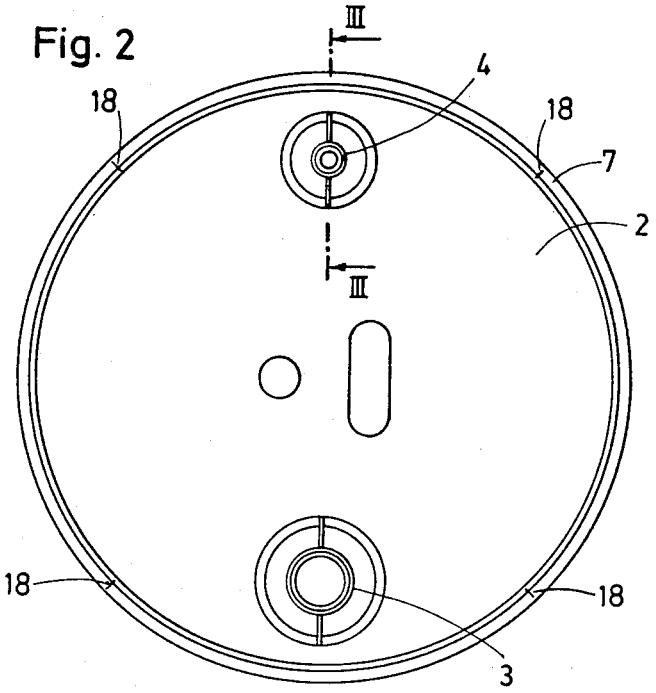
Figure 4:
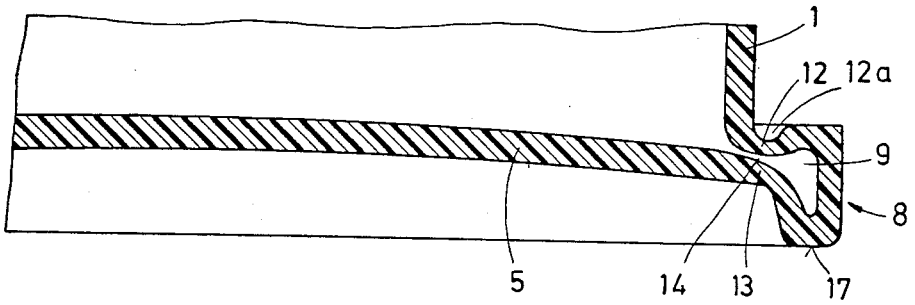
Figure 5:
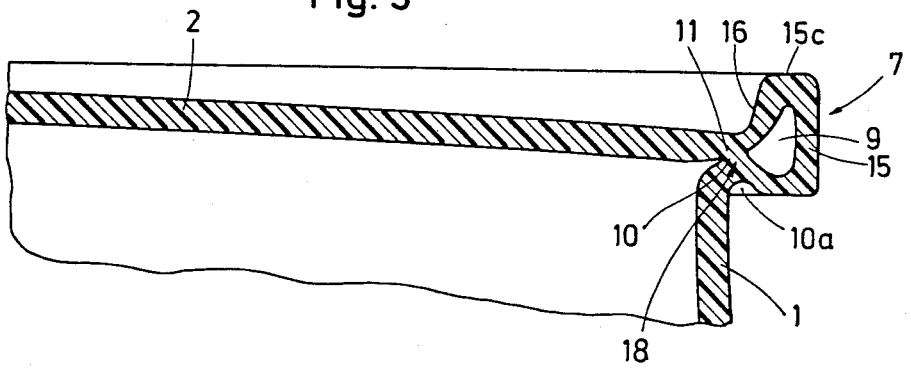
Figure 6:
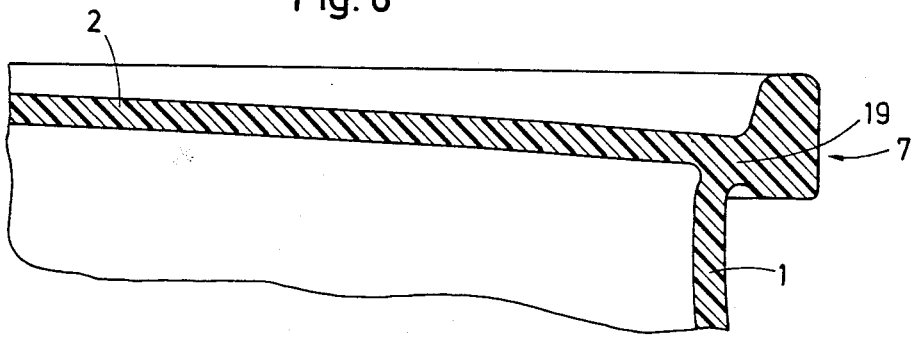
Figure 7:
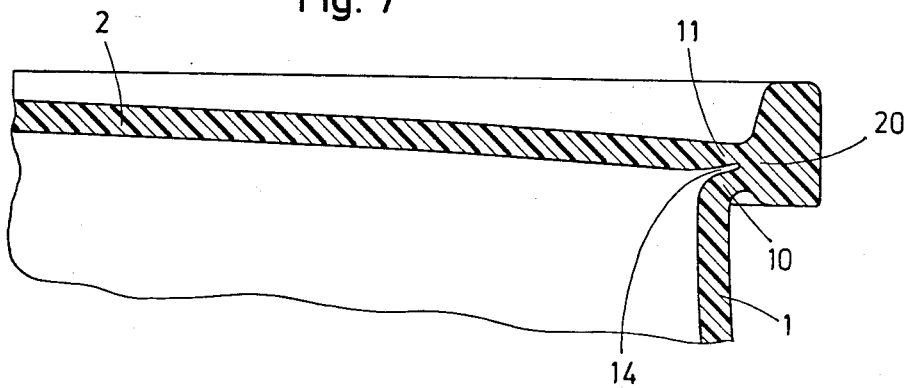

The invention will be described in detail below with reference to the embodiments illustrated in the drawings wherein:

FIG. 1 is a lateral view of the bunghole-equipped barrel according to this invention, FIG. 2 shows a top view of the bunghole-equipped barrel of FIG. 1, FIG. 3 shows an enlarged section along line III—III of FIG. 2, FIG. 4 shows a section corresponding to FIG. 3 in the transitional zone between the barrel sidewall and the head, FIG. 5 shows a cross-sectional view of the upper rolled ring in the zone of a predetermined breaking point of a bunghole-equipped barrel comprising such breaking points, and FIGS. 6 and 7 show cross-sectional views corresponding to that of FIG. 5 of two modified embodiments of the predetermined breaking points of the upper rolled ring.

The barrel according to FIGS. 1-4 with sidewall 1, top head 2 including filling and discharging nipples 3 and venting nipple 4, as well as bottom head 5, is blow molded in a mold, not shown, from an extruded synthetic resin tube. The synthetic resin material utilized is preferably a high-molecular high-density polyethylene.

By moving the mold parts, not shown, toward each other in the direction of the longitudinal axis 6—6 of the barrel, a top rolled ring 7 is formed bead-like directly from the barrel sidewall 1 and the top head 2, and a bottom rolled ring 8 is formed bead-like directly from the sidewall 1 and the lower head 5 with the formation of an annular cavity 9 open toward the interior of the barrel.

During the heading of the rolled rings 7, 8, an upper marginal zone 10 of the barrel sidewall 1 and an outer marginal zone 11 of the top head 2, as well as a lower marginal zone 12 of the barrel sidewall 1 and an outer marginal zone 13 of the lower head 5 are moved toward each other, for the formation of an open gap 14, only to such an extent that these zones are not welded together.

The upper rolled ring 7 and the lower rolled ring 8 each exhibits an outer wall 15 with an annular, radial lower wall portion **15*a*, a cylindrical wall portion 15*b* arranged coaxially to the barrel axis 6—6, and an annular, radial upper wall portion 15*c*, as well as an inner conical wall 16**.

The upper rolled ring 7 and the lower rolled ring 8 project in the direction of the longitudinal axis 6—6 of the barrel past the upper and lower heads 2, 5. The lower rolled ring 8 exhibits an annular standing surface 17. However, also the upper rolled ring 7 projects axially to such a degree that the barrel can also stand on its head without damage to the nipples 3, 4.

The barrel sidewall 1 is retracted below the upper rolled ring 7 at **10*a* a and above the lower rolled ring 8 at 12*a* so that the points of engagement for gripper and conveying means, for example transporting devices with a "parrot's beak", are enlarged at the upper and lower rolled rings 7, 8**.

In a modification of the aforedescribed structure of a bunghole-equipped barrel, the upper marginal zone 10 of the barrel sidewall 1 can be welded together over the barrel circumference at various spots with the outer marginal zone 11 of the upper head 2; and the lower marginal zone 12 of the barrel sidewall 1 can be welded together in the same way with the outer marginal zone 13 of the lower head 5, for the formation of predetermined breaking points 18 in case of external and/or internal overstressing. This is illustrated in FIG. 5.

Another embodiment of a predetermined breaking point 19 is shown in FIG. 6 wherein the upper rolled ring 7, and correspodingly the lower rolled ring 8, have a solid profile.

Finally, according to FIG. 7, the above-mentioned, spotwise welding together of the outer wall 15 with the inner wall 16 of the rolled rings 7, 8 can be effected for the formation of predetermined breaking points 20 wherein the gap 14 adjoining the rolled rings 7, 8 remains preserved between the upper marginal zone 10 of the barrel sidewall 1 and the outer marginal zone 11 of the upper head 2, as well as between the lower marginal zone 12 of the barrel sidewall 1 and the outer marginal zone 13 of the lower head 5.

The predetermined breaking points 18, 19, 20 are preferably distributed uiformly over the barrel circumference.

The aforedescribed formation of the rolled rings ensures that, in case of a drop of the filled barrel from a medium or relatively large height onto the top lid or onto the bottom head, the thus-occurring crushing forces will be elastically absorbed by way of the rolled rings acting as compensating means and will be conducted directly into the barrel sidewall, and the crushing route is short, even in case of large crushing forces. The same crushing force characteristic is displayed by the bunghole-equipped barrel when being stacked. The bending moments transmitted to the rolled rings by external crushing forces during dropping or while being stacked are minor. In case a stress is exerted on the barrel which greatly exceeds the permissible limit, on account of external forces, such as crushing forces during a drop, as well as due to increased internal pressure due to evaporating liquid, the predetermined breaking points formed by the rolled rings will rupture like snap fasteners before the breaking load limit of the barrel material is reached, without the springing of leaks due to crack formation in the barrel sidewall, top head or bottom head of the barrel. Rupturing of the predetermined breaking points of the upper or lower rolled ring becomes visible by white fracture or white fractures in the marginal zone on the outside of the upper and lower head, respectively. In case of extreme external or internal overstressing, the barrel sidewall can bulge in the region of the rolled rings after rupturing of the predetermined breaking points without any leaks showing in the barrel.

The rolled rings readily withstand the normal manipulations of the bunghole-equipped barrel, such as rolling by way of the rim or sidewall, as well as standing on edge.

The bunghole-equipped barrel can be utilized as a returnable barrel.

I claim:

1. In a bunghole-equipped barrel of a thermoplastic synthetic resin, produced by blow molding, with hollow rolled rins arranged coaxially to the cylindrical barrel sidewall in the zone of the upper and lower heads, these rolled rings projecting in the direction of the longitudinal axis of the barrel past the heads, there being a cavity between these rolled rings which is in communication with the barrel chamber by way of a gap, the lower rolled ring having an annular standing surface arranged concentrically to the barrel center; the improvement in which at least one of the rolled rings has predetermined breaking points (18–20) spaced apart uniformly over the barrel circumference, said breaking points each comprising means interconnecting said rings across said gap.

2. Bunghole-equipped barrel according to claim 1, in which there are welded together, in a spotwise fashion, over the barrel circumference: the upper marginal zone (10) of the barrel sidewall (1) with the outer marginal zone (11) of the upper head (2); and/or the lower marginal zone (12) of the barrel sidewall (1) with the outer marginal zone (13) of the lower head (5), for the formation of said predetermined breaking points (18) in case of external and/or internal overstressing

3. Bunghole-equipped barrel according to claim 1, in which the upper (7) and/or the lower (8) rolled led ring have a solid profile in the zone of the predetermined breaking points (19).

4. Bunghole-equiped barrel according to claim 1, in which there is a spotwise welding together of the outer (15) and of the inner (16) wall of the upper (7) and/or lower (8) rolled ring, for the formation of said predetermined breaking points (20).

5. Bunghole-equipped barrel according to claim 1, in which the barrel sidewall (1) is retracted (at **10*a* and 12*a*, respectively) below the upper rolled ring (7) and above the lower rolled ring (8)**.

* * * * *